United States Patent [19]

Hollister et al.

[11] 4,126,844

[45] Nov. 21, 1978

[54] ELECTRICAL INDUCTIVE APPARATUS

[75] Inventors: Robert H. Hollister; Jerry W. Crockett, both of South Boston; Harold R. Younger, Jr., Halifax; Garland B. Ricketts, South Boston, all of Va.

[73] Assignee: Westinghouse Electric Corp., Pittsburgh, Pa.

[21] Appl. No.: 824,594

[22] Filed: Aug. 15, 1977

[51] Int. Cl.[2] ..... H01F 27/30

[52] U.S. Cl. ..... 336/198; 29/605; 336/225

[58] Field of Search ..... 336/196, 198, 206, 223, 336/225, 227, 228; 29/605, 606, 602 R; 310/194

[56] References Cited

U.S. PATENT DOCUMENTS

| | | | |
|---|---|---|---|
| 1,608,891 | 11/1926 | Lee | 336/196 |
| 2,666,168 | 1/1954 | Lorant | 336/206 X |

FOREIGN PATENT DOCUMENTS

| | | | |
|---|---|---|---|
| 970,447 | 9/1958 | Fed. Rep. of Germany | 336/196 |

*Primary Examiner*—Thomas J. Kozma
*Attorney, Agent, or Firm*—D. R. Lackey

[57] ABSTRACT

An electrical inductive apparatus having a magnetic core with a rectangular core leg portion surrounded by a winding tube assembly around which is disposed a plurality of turns of an electrical conductor. The winding tube assembly consists of four members which interlock to form a rectangular opening around the core leg. Two of the members of the winding tube assembly, which are disposed adjacent the shorter dimension of the core leg, have a plano-convex cross-sectional configuration that resists movement of the electrical conductor along this axis of the core. A method of constructing an electrical winding for an electrical inductive apparatus having a rectangular core leg is disclosed.

4 Claims, 2 Drawing Figures

ELECTRICAL INDUCTIVE APPARATUS

BACKGROUND OF THE INVENTION

1. Field of the Invention

This invention relates, in general, to electrical inductive apparatus and, more specifically, to electrical inductive apparatus having rectangular shaped magnetic cores.

2. Description of the Prior Art

It is common in electrical inductive apparatus, such as transformers, reactors and the like, to construct a magnetic core having rectangularly shaped leg members with electrical windings, comprised of a plurality of turns of strap or sheet conductors, disposed therearound. A winding tube is disposed between the windings and the core to electrically insulate the windings from the grounded core and further serves to hold the windings in the desired rectangular shape during their sub-assembly on various coil winding machines. Typically, the winding tube is constructed of pressboard due to its superior electrical insulating characteristics.

The rectangular core type construction has been limited in the past to certain ratings since larger units have been unable to meet the short circuit withstand requirements. During a short circuit, the low voltage and high voltage windings tend to separate with the low voltage winding being compressed against the core and the high voltage winding being subject to an outward tensile force. Unless the windings are tightly wound around the core, gaps will exist between the turns of the windings which allow the windings to vibrate during a short circuit. This repeated vibration eventually breaks the insulation or the conductor thereby destroying the transformer. One of the primary reasons for the existence of voids between the turns of the windings is the dimensional instability of the pressboard material commonly used in the winding tube. Pressboard has a tendency to shrink during the curing of the transformer since the moisture absorbed by the pressboard during storage and handling is driven out by the high temperatures used in the assembly of the transformer. Further, the pressboard compresses during the processing of the transformer which opens up additional gaps or spaces between the turns of the windings. The dimensions of the pressboard winding tube vary across its length due to inherent manufacturing variations and the fact that it is difficult to bend the pressboard into a rectangular shape that is square or parallel with the edges of the core.

During the assembly of the transformer, pressure is applied to the longer axis or length of the windings to compress the windings and thereby reduce the space factor of the transformer. This eliminates the gaps between the turns of the windings along this axis of the transformer. However, the excess material that was originally present along the length of the coils appears at the ends of the windings, adjacent the width thereof, which adds additional gaps or looseness to the windings along this dimension of the transformer.

During the sub-assembly of the windings, the winding tube is initially secured around the mandrel of a coil winding machine. Due to the dimensional instability of the pressboard winding tube, in particular its varying thickness across its length and the difficulty involved in bending the pressboard into a rectangular form with parallel sides, the outer surface of the winding tube is generally not parallel with the surfaces of the mandrel or of the sheets of insulation and sheet conductor. This misalignment causes creases or wrinkles to form in the insulation and sheet conductor as they are wound around the winding tube which adversely affects the electrical characteristics of the windings. It is known that a crease or wrinkle in a sheet of paper insulation will greatly reduce its dielectric strength. Further, a crease or wrinkle could break the sheet conductor, which is typically aluminum in thicknesses of 0.005 inches to 0.040 inches. In order to reduce the occurrence of wrinkles or creases, the tension applied to the sheets of insulation and conductor during their winding around the winding tube must be reduced which, accordingly, results in a loose winding having gaps therein.

Therefore, it is desirable to provide a transformer having rectangular core legs which has a higher rating than previously attainable due to improved short circuit withstand capability. It would also be desirable to provide such a transformer that has a winding tube that is dimensionally stable over the range of conditions encountered during the construction of the transformer. It would also be desirable to provide a winding tube which has an outer surface that is parallel to the surface of the mandrel of the coil wnding machine and the sheets of insulation and conductor.

SUMMARY OF THE INVENTION

Herein disclosed is an electrical inductive apparatus, such as a transformer, having a magnetic core with a rectangular core leg portion which has a higher rating than that previously attainable for such apparatus. The transformer has a rectangular core leg surrounded by a winding tube assembly around which is disposed a plurality of turns of an electrical conductor. The winding tube assembly includes two members having a rectangular cross-sectional configuration and two members having a plano-convex cross-sectional configuration wherein the outer surface is curved outwardly relative to the flat inner surface. The four members of the winding tube assembly interlock such that the inner surfaces thereof form a rectangular opening wherein the core leg is disposed. The two members having the planoconvex configuration are disposed adjacent the shorter axis of the core leg and minimize the effects of material buildup of the conductor along this axis of the transformer which reduces the formation of gaps between adjacent turns of the conductor. A tighter winding results which increases the short circuit withstand capability of the transformer and thereby enables a higher rating to be attained since there is less movement of the turns of the conductor during a short circuit.

The winding tube assembly is constructed of an electrically insulating material that is substantially non-compressible and non-shrinkable under the normal temperatures and pressures utilized in the construction of apparatus of this nature. Thus, the formation of additional gaps between the winding and the winding tube are prevented since the winding tube assembly remains dimensionally stable throughout the construction of the transformer. In addition, the four members of the winding tube assembly interlock to form a solid support structure without the need for additional bonding which thereby allows slight movement of the members relative to each other during assembly which reduces stresses in the winding tube which tend to deform the tube and create additional gaps between the turns of the conductor.

Furthermore, the assembly of the sheets of electrical conductor and insulative material into a winding is simplified since the four members of the winding tube assembly form to the shape of the mandrel despite dimensional tolerances therebetween which insures that the surfaces of the winding tube assembly remain parallel to the axis of the mandrel and the surfaces of the electrical conductor and insulative material. Thus, the occurrence of creases in the sheets of electrical conductor and insulative material, which adversely affect the electrical characteristics of the transformer, are reduced. In addition, increased tension can be applied to the electrical conductor and insulative material as they are formed into the winding thereby resulting in a tighter coil having fewer gaps therein.

BRIEF DESCRIPTION OF THE DRAWINGS

The various features, advantages and other uses of this invention will become more apparent by referring to the following detailed description and drawings, in which.

DESCRIPTION OF THE PREFERRED EMBODIMENT

Figure 1:
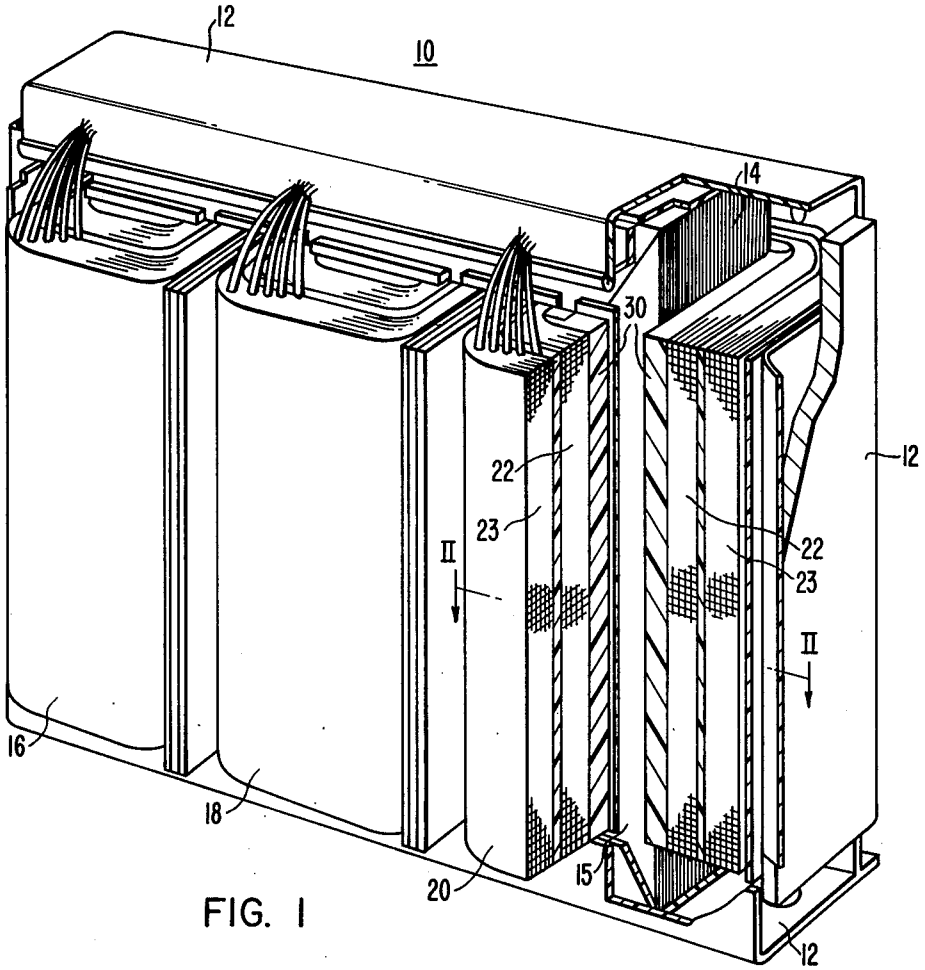
FIG. 1 is an elevational view of an electrical inductive apparatus constructed according to the teachings of this invention with a portion of a winding structure cutaway for clarity.

Throughout the following description, similar reference characters refer to similar elements or members in all the figures of the drawing.

Referring now to the drawing, and to FIG. 1 in particular, there is shown an electrical inductive apparatus 10, such as a power distribution transformer, constructed according to this invention. A frame structure 12 encloses and supports a three-phase magnetic core 14 having three core legs, such as core leg 15, each of which has a substantially rectangular cross-section. Around the legs of the magnetic core 14 are disposed the winding structures 16, 18 and 20.

The cut-away portion of FIG. 1 illustrates the details of the winding structure 20. Winding structures 16 and 18 are constructed similar to the winding structure 20. A low-voltage winding 22 is constructed of a plurality of turns of a suitably shaped conductor. Either sheet or strap conductor material may be used with appropriate insulating material disposed between the turns of the conductor. The conductor is wound around a winding tube assembly 30 and is disposed in inductive relation with the magnetic core 14.

A high voltage winding 23 is constructed of a plurality of turns of a foil or sheet conductor and is wound around the low voltage winding 22. For clarity, the electrical leads and bushings used to connect the low voltage and high voltage conductors, 22 and 23, to an electric load and a source of electrical potential are not shown. Although a three-phase transformer is shown, the teachings of this invention are equally applicable to single phase units as well.

It is common in the construction of a transformer to dispose a winding tube between the innermost turns of the low voltage conductor and the magnetic core to provide electrical insulation between the low voltage conductor and the grounded magnetic core. The winding tube also serves to hold the windings in the desired shape during their subassembly in automatic winding machines.

For a better understanding of this invention, a brief description of several design considerations for electrical inductive apparatus, such as transformers, will be presented before the novel aspects of this invention are described in detail. As is well known to those skilled in the art, electrical inductive apparatus, such as transformers, experience short circuits. During a short circuit, the high voltage and low voltage conductors are forced apart such that the low voltage conductor is compressed against the magnetic core and the high voltage conductor is stressed in tension. Thus, the maximum rating of a transformer is determined to a certain extent by its short circuit withstand capability. Although various mechanical means are used to securely hold the windings in place, a primary cause of short circuit failures and, thus, a limitation on the maximum rating of a transformer is the tension of the windings. Any looseness in the windings forms gaps or spaces which allow movement of the windings during a short circuit. During a short circuit, the windings are exposed to severe vibrations at the 60 Hz power frequency which ultimately cause the windings or the insulation disposed therebetween to break thereby destroying the transformer. Certain transformer constructions, such as those having a rectangular core and sheet-type windings, have been limited, in the past, to certain ratings due to their relatively poor short circuit withstand capability. Rectangular wound coils possess inherent looseness or gaps since the coils must be bent to the desired rectangular shape which introduces looseness in the windings across the flat surfaces of the magnetic core. Although pressure is normally applied to one axis of the windings during the construction of the transformer to eliminate any gaps therein and to thereby improve the space factor of the transformer, the excess material along this axis of the windings is merely forced to the ends thereof adjacent the other axis of the windings. This excess material introduces additional looseness into the windings along this other axis thereby increasing the amount of looseness or gaps in this portion of the windings.

Figure 2:
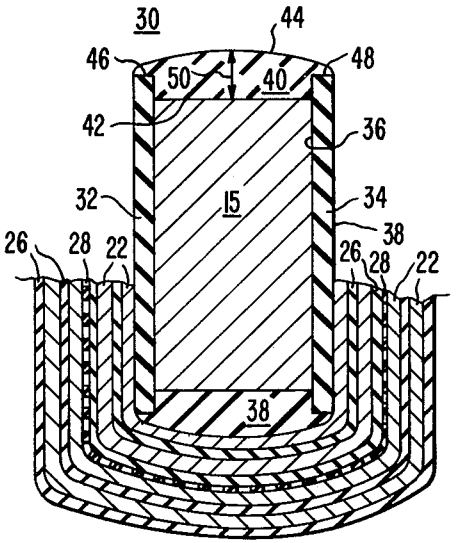
FIG. 2 is a sectional view, generally taken along line II—II in FIG. 1, showing a winding tube constructed according to the teachings of this invention.

The novel aspects of this invention which overcome the aforementioned problems in certain transformer constructions, such as those having a rectangular core and sheet-type windings, will now be presented. Accordingly, there is shown in FIG. 2 a unique winding tube assembly 30 which reduces the amount of looseness or gaps in a transformer having a rectangular core and sheet-type windings and thereby enables a rectangular core and coil transformer to be constructed with a higher rating than that previously possible using prior art methods. FIG. 2 is a sectional view of one phase of the transformer 10. For clarity, only a portion of the phase winding 20, such as low voltage conductor 22, is shown around the core leg 15. The turns of the low voltage conductor 23 are insulated from each other by a suitable electrically insulated material 26, such as kraft paper, which further includes a plurality of radially disposed spacers 28 which form vertically extending ducts through the low voltage conductor 22 for coolant flow.

A winding tube assembly 30 is disposed adjacent the leg of the magnetic core 15 to electrically insulate the low voltage conductor 22 which have an electrical potential impressed thereon, from the grounded core 15. The winding tube assembly 30 includes first and second members 32 and 34, respectively, which are associated with one axis or dimension of the rectangular core 15. The first and second members, 32 and 34, have a rectangular cross-sectional configuration with flat inner and outer surfaces. The first and second members 32 and 34 also have a length slightly longer than the length of the core 15 such that the longitudinal edges between the inner and outer surfaces of the first and second members 32 and 34 extend slightly beyond the ends of the core 15. The winding tube assembly 30 further includes third and fourth members 38 and 40, respectively, which are disposed adjacent the other axis or dimension of the magnetic core 15 and interlock with the first and second members 32 and 34 to provide a solid support for the windings. Since the third and fourth members 38 and 40 are identical, only member 40 will be described in detail hereafter. The fourth member 40 has a plano-convex cross-sectional configuration wherein the outer surface 44 is curved outwardly relative to the flat inner surface 42. This cross-sectional configuration was found to greatly reduce the amount of looseness in the windings although other configurations wherein the outer surface 44 is not parallel to the inner surface 42 could also be utilized within the scope of the teachings of this invention. Thus, the outer surface 44 of the fourth member 40 forms a substantially arcuate surface with respect to the inner surface 42. The dimension 50 of the fourth member 40 is selected to minimize the overall width of the transformer 10 and to further reduce the effect of excessive material buildup along this axis of the windings.

It is felt that the arcuate or convex shape of the outer surface 44 of the fourth member 40 significantly reduces the effect of the excessive material buildup that occurs along this axis of the winding during the construction of the transformer 10. It is common during the construction of a transformer to apply pressure along one axis of the windings, such as the sides of the windings disposed adjacent the first and second members 32 and 34 of the winding tube assembly 30, to eliminate any looseness or gaps along this axis of the windings and thereby improve the overall space factor of the transformer. However, this application of pressure forces any excess material in the windings to the ends of the windings or to the portion of the windings disposed adjacent the third and fourth members 38 and 40 of the winding tube assembly 30. This excess material buildup introduces additional looseness or gaps in this portion of the winding which permits movement of the winding during a short circuit fault condition. By making the outer surface of the fourth member 40 non-parallel with the inner surface thereof the effects of this excessive material buildup are minimized which provides a tighter winding with fewer gaps in the portion of the winding adjacent the third and fourth members 38 and 40. Thus, movement of the winding during a short circuit fault condition is minimized thereby increasing the short circuit withstand capability of the transformer which enables a rectangular core and coil transformer to be constructed that has a higher rating than that previously attainable.

Prior art winding tubes for rectangular core and coil transformers have been constructed of pressboard which is bent or formed into the desired rectangular shape. However, the use of pressboard introduces dimensional instability into the design of a transformer since pressboard has a tendency to absorb moisture during storage and handling. During the curing of the transformer, the moisture is driven out of the pressboard which thereby causes a shrinkage in the winding tube which opens up gaps or voids between the winding tube and the innermost turn of the low voltage conductor 22. In addition, the application of pressure to the windings, as described above, causes a slight compression of the pressboard which opens up additional gaps between the winding tube and the innermost turn of the low voltage conductor 22. Furthermore, it is difficult to bend the corners of the pressboard parallel with respect to each other which thereby causes dimensional variations across the length of a rectangular pressboard winding tube.

In order to overcome these problems and thereby provide dimensional stability for the winding tube 30, the individual components of the winding tube assembly 30 are constructed of an electrically insulating material which is substantially non-compressible and non-shrinkable under the normal temperatures and pressures experienced during the processing of apparatus of this nature. It is to be expressly understood that the terms non-compressible and non-shrinkable, for the purposes of this specification and the claims, are associated with materials that are non-compressible and non-shrinkable under the normal temperatures and pressures utilized during the processing of apparatus of this nature. Typical materials with these properties include ones sold commercially under the trade names "Micarta" and "Lebonite". Besides providing the required electrical insulation, these materials also exhibit the necessary properties of non-compressibility and non-shrinkability over the temperatures and pressures encountered during the construction of a transformer. In addition, these materials are easy to machine into the desired shape of the third and fourth members 38 and 40.

The winding tube assembly 30 further includes means for interlocking the four members together in order to provide a solid support structure for the windings that retains its rectangular configuration throughout the construction of the transformer 10. Accordingly, the fourth member 40 includes recessed shoulder portions 46 and 48 which extend the entire length of the fourth member 40. The ends of the first and second members 32 and 34 are disposed in registry with the shoulder portions 46 and 48 of the fourth member 40 and also with the corresponding shoulder portions of the third member 38 to provide the aforementioned solid support for the windings.

By interlocking the four members of the winding tube assembly 30, as described above, the need for an additional bonding agent to join them together is eliminated. Thus, the individual members can move relative to each other and, yet, retain its rectangular configuration during the construction of the transformer 10 which reduces the buildup of stress within the winding tube 30 which would tend to deform the tube 30 and create additional gaps between it and the low voltage conductor 22.

The use of individual components to form the winding tube 30 enables accurate dimensions to be maintained which simplifies the loading of the windings onto the core 15. The dimensional instability of prior art type press-board winding tubes that resulted from the variations in height and the inability to bend the corners of the press-board winding parallel to the surfaces of the core leg necessitated a larger core window than absolutely necessary in order for the windings to be loaded onto the core 15. Filler pieces were required to be added between the press-board winding tube and the core to provide additional support and mechanical strength for the windings. The novel winding tube assembly 30 described herein eliminates the need for the additional filler pieces since the dimensions of the core window can be accurately maintained.

In addition to providing increased short circuit withstand capability, the novel winding tube assembly 30 described herein also simplifies the assembly of the windings. In actual practice, the sheets of electrical conductor and insulation are formed into the windings on a coil winding machine. A typical coil winding machine includes an expandable mandrel whose exterior surfaces define a rectangular cross-section, slightly larger than that of the core leg, and, further, which are parallel to the longitudinal axis through the center of the mandrel. A supply of electrically conductive material and, if desired, electrically insulative material is provided in the coil winding machine with the planar surfaces of both the conductor and insulation being parallel to the longitudinal axis of the mandrel within machine tolerance. The winding tube is then assembled around the mandrel with the inner surface of the first and second members, 32 and 34, being disposed in registry with the correspondingly sized surfaces of the mandrel. Similarly, the planar inner surfaces of the third and fourth members, 38 and 40, of the winding tube assembly 30 are disposed in registry with the other similar sized surfaces of the mandrel and interlocked with the first and second members 32 and 34. Thus, the first and second members 32 and 34 are disposed in parallel adjacent opposing surfaces of the mandrel; while the third and fourth members, 38 and 40, are disposed in parallel adjacent the other opposing surfaces of the mandrel. The electrical conductor and insulating material are then pulled from their respective supply rolls, under tension, to engage the winding tube; whereon the mandrel is rotated until the desired number of turns of the electrical conductor, with the insulating material interwoven therebetween, are formed. The winding tube with the windings carried thereon is then removed from the mandrel and placed over the core leg of the transformer.

Due to the dimensional instability of the prior art type pressboard winding tubes; namely, the varying thickness across its length and the non-square corners, it has been difficult to insure that the exterior surface of the winding tube was parallel to the longitudinal axes of the mandrel and the sheets of electrical conductor and insulative material. This caused creases or wrinkles in the sheets of electrical conductor and insulation as they are wound around the winding tube. As is well known in the art, a crease or wrinkle in a sheet of insulative material significantly decreases its dielectric strength. Furthermore, the electrical conductor, typically aluminum in thicknesses ranging from 0.005 inches to 0.040 inches, is susceptible to creasing or wrinkling which could result in a rip or breaking of the electrical conductor. It had been necessary to reduce the tension applied to the sheets of electrical conductor and insulation as they are wound around prior art type winding tubes in order to enable the operator to smooth out any creases or wrinkles that may form. The reduction in tension further increases the looseness of the windings and results in an increase in the number and size of gaps therein. The novel winding tube assembly 30 of this invention has improved dimensional stability which insures that the exterior surface of the winding tube 30 is substantially parallel to the longitudinal axes of the mandrel and the sheets of electrical conductor and insulative material within machine tolerances. This not only reduces the occurrence of creases or wrinkles in the sheets of electrical conductor and insulative material, but also enables more tension to be applied to the electrical conductor and insulative material as they are formed into windings which results in a tighter winding with fewer gaps.

Thus, it will be apparent to one skilled in the art that there has been herein disclosed an electrical inductive apparatus having a magnetic core with a rectangular core leg portion that has a higher rating than previously attainable due to improved short circuit withstand capability. The improvement in short circuit withstand capability results in part from a winding tube assembly that remains dimensionally stable throughout the temperatures and pressures utilized in constructing apparatus of this nature which eliminates the formation of voids between the winding tube and the windings. The use of components in the winding tube, having a plano-convex cross-sectional configuration, along one axis of the core leg minimizes the effects of buildup of the conductor along this axis during the construction of the transformer and thereby results in a tighter winding which experiences less movement during a short circuit condition. Furthermore, the winding tube assembly described herein simplifies the construction of the winding since the exterior surface of the winding tube is parallel to the sheets of electrical conductor and insulating material which reduces the occurrence of wrinkles or creases in the conductor and insulating material as it is wound around the winding tube and, further, allows increased tension to be applied to the conductor as it is being wound which results in a tighter winding.

What is claimed is:

1. Electrical inductive apparatus comprising:

a magnetic core including a vertically-extending leg portion having a rectangular cross-sectional configuration;

a winding tube assembly disposed around said leg portion; and an electrical winding disposed in inductive relation with said magnetic core and forming a plurality of concentric turns around said winding tube assembly, said electrical winding having a substantially rectangular cross-sectional configuration and being subject to radial forces incident to a short circuit, said electrical winding being substantially in registry with the entire exterior surface of said winding tube assembly;

said winding tube assembly including first, second, third, and fourth members, each constructed of solid, electrically insulating material which is substantially non-compressible and non-shrinkable, said first, second, third and fourth members each having an inner exterior surface disposed facing said leg portion of said core and an outer exterior surface disposed facing said electrical winding, said first and second members having a rectangular cross-sectional configuration, said third and fourth members having a plano-convex cross-sectional configuration wherein said outer surface of each member is curved outwardly relative to said flat inner surface to provide a solid support structure for said electrical winding adjacent said third and fourth members which resists movement of said electrical winding due to said radial forces incident to a short circuit, and means for interlocking each of said first and second members with both of said third and fourth members to provide a solid support structure for said electrical winding that retains its shape during the assembly and operation of said electrical inductive apparatus.

2. The electrical inductive apparatus of claim 1 wherein the means for interlocking the first and second members of the winding tube with both of the third and fourth members thereof includes each of said third and fourth members having recessed shoulders adjacent each edge of the inner surface thereof which extend the entire length of said third and fourth members and, further, said first and second members having a length slightly larger than the length of the core leg such that said first and second members extend beyond the edge of said core leg to engage said shoulders in said third and fourth members to provide a solid support structure for the winding.

3. A method of constructing an electrical winding comprising the steps of:

providing a mandrel having exterior surfaces that define a rectangular cross-sectional configuration with each of said surfaces disposed parallel to the longitudinal axis through the center of said mandrel;

providing an electrical conductor having a planar surface that is parallel to each of said surfaces of said mandrel when said conductor is brought in contact therewith;

assembling a winding tube assembly, including first and second members having inner and outer surfaces defining a rectangular cross-sectional configuration and third and fourth members having a plano-convex cross-sectional configuration wherein the outer surface of each of said third and fourth members is curved outwardly relative to the flat inner surface, around said mandrel such that said inner surfaces of said first, second, third and fourth members are disposed in registry with the corresponding surfaces of said mandrel and said first and second members are disposed adjacent opposing surfaces of said mandrel and said third and fourth members are disposed adjacent the other opposing surfaces of said mandrel;

interlocking said first and second members of said winding tube assembly with each of said third and fourth members thereof to form a solid support for said conductor that retains its shape after removal from said mandrel;

engaging said conductor with an outer surface of said winding tube;

rotating said mandrel such that said conductor is substantially in registry with the entire exterior surface of said winding tube assembly;

advancing said conductor in conjunction with the rotating of said mandrel to form a predetermined number of turns of said conductor around said winding tube assembly, each having a rectangular cross-sectional configuration;

applying tension to said conductor as it is wound around said winding tube assembly; and removing said winding tube with said conductor wound therearound from said mandrel.

4. The method of claim 3 further including the step of advancing a layer of electrically insulating material along with the advancing of said conductor such that said insulating material is interwoven between adjacent turns of said conductor around said winding tube.

* * * * *